United States Patent [19]

Nigmela

[11] 4,437,245

[45] Mar. 20, 1984

[54] MEANS FOR MAKING A SKI TRAIL

[76] Inventor: Tapio Nigmela, Linnatie 10D5, Kittila, Finland, 99100

[21] Appl. No.: 443,162

[22] Filed: Nov. 19, 1982

[30] Foreign Application Priority Data

Dec. 3, 1981 [FI] Finland ..... 813868

[51] Int. Cl.[3] ..... E01H 4/00

[52] U.S. Cl. ..... 37/222; 37/224; 172/145

[58] Field of Search ..... 37/221, 222, 223, 224, 37/232; 172/145, 787, 153, 154, 156, 157, 150

[56] References Cited

U.S. PATENT DOCUMENTS

| | | | |
|---|---|---|---|
| 955,590 | 4/1910 | Grimes | 37/224 |
| 1,013,298 | 1/1912 | Kuhns | 172/152 |
| 2,881,540 | 4/1959 | Sprague | 172/787 X |
| 3,652,106 | 3/1972 | Waterman | 37/224 X |
| 3,878,900 | 4/1975 | Boisse et al. | 172/145 |
| 3,963,079 | 6/1976 | Carlucci | 172/145 X |
| 4,014,116 | 3/1977 | Baechler | 37/221 X |
| 4,021,942 | 5/1977 | Purdy | 37/222 |
| 4,056,328 | 11/1977 | Maxey | 37/222 X |
| 4,163,329 | 8/1979 | Neff | 37/222 |
| 4,341,027 | 7/1982 | Rohner | 37/221 |

*Primary Examiner*—E. H. Eickholt

[57] ABSTRACT

A ski trail making means, composed of a frame for attachment e.g. behind a snowmobile and to which has been pivotally connected a drag adjustable in vertical direction, following after which is a trail planer with trail making blades side by side, after which follows a cylindrical levelling roll supporting the means. The drag is suspended by linkage arms pivoted to the frame in such manner that it is free to rise upwardly. The trail planer is resiliently attached to the frame. The levelling roll carries projecting trail groove depressor rims. The means of the invention has a light-weight design and is therefore well fit to be towed e.g. with a snowmobile. The means is also advantageous owing to its simplicity.

3 Claims, 3 Drawing Figures

MEANS FOR MAKING A SKI TRAIL

The present invention concerns a ski trail making means consisting of a frame that can be hitched behind a snowmobile, for instance, and to which has been pivotally attached a drag adjustable in vertical direction, after which follows a trail planer with trail making blades mounted side by side, and after which comes a cylindrical levelling roll, which supports the means.

The invention aims at developing further a ski trail making means which is light-weight and towable for instance by a snowmobile. The ski trail making means of the invention is characterized in that the drag is suspended by linkage arms pivotally attached to the frame so as to be enabled unrestrictedly to rise upwards, and that the trail planer has been resiliently mounted on the frame, and that the levelling roll has projecting trail groove depressing rims. With the aid of the invention, the drag will by its own weight uniformly level out any old ski trails, and tracks after snowmobiles. If a hummock is encountered, or an obstacle such as a stone, the drag is free to rise upwardly. The drag's own weight suffices to level the snow. The trail planer coming after scrapes new grooves, from which the snow is directed to the sides. The resiliently attached trail planer also conforms to uneven shapes of the terrain. The drag and the trail planer produce snow grist, and this is pressed smooth by the trailing levelling roll and by the depressor rims thereon. The depressor rims on the levelling roll keep the ski trail making means well-steered even at precipitous spots. The means is light and inexpensive of its design, and it is excellently fit to be used with snowmobiles.

An advantageous embodiment of the invention is characterized in that the drag has a plurality of successive blades, of which one at least carries a snow collecting plate, directed obliquely upward and forward. Hereby the snow collecting plate hoards snow to be used for instance to fill pits and old, deep ski trails. There may also on the side of the drag be provided plates parallelling the direction of travel, which keep the snow within the drag.

Another embodiment of the invention is characterized in that spring suspension of the trail planer has been provided by using telescopic springs inserted between the trail planer and the frame. A spring suspension arrangement like this is simple and easy to attach both to the frame and to the trail planer.

The invention is described in the following with the aid of an example, with reference being made to the attached drawing, wherein FIG. 1 presents the ski trail making means in elevational view.

Figure 1:
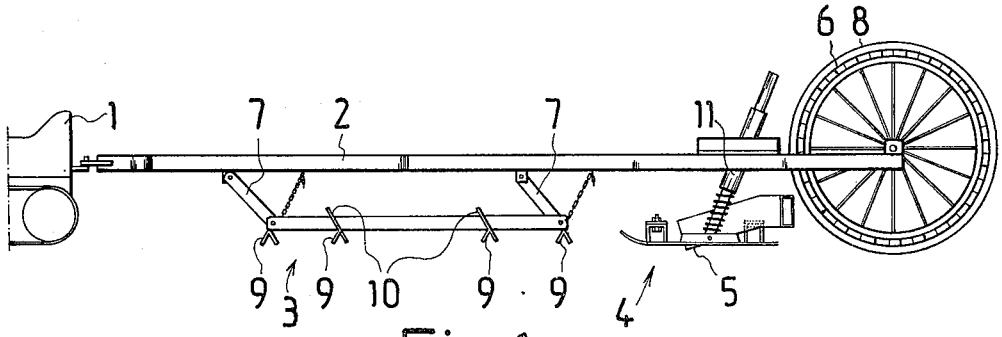
Figure 2:
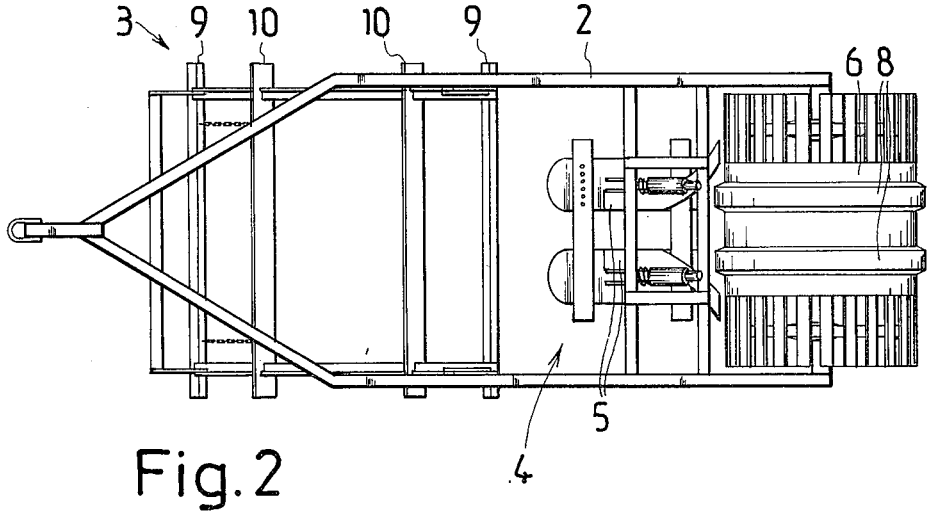
FIG. 2 shows the ski trail making means, viewed from above.
Figure 3:
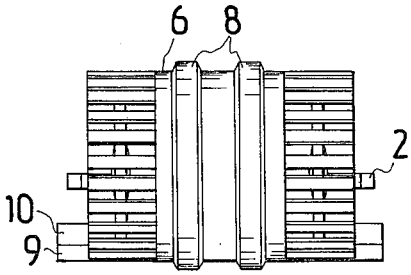
FIG. 3 shows the ski trail making means, viewed from the rear.

The ski trail making means consists of a frame 2 connected behind a snowmobile 1 and to which has been pivotally attached a drag 3 adjustable with reference to the direction of travel in vertical direction, after which comes a trail planer 4 with trail-making blades 5 mounted side by side. Farthest in the rear is a cylindrical levelling roll 6, supporting the means. The drag 3 is suspended from the frame 2 by linkage arms 7 pivoted to this frame, so that it is free to rise upwardly. The trail planer 4 is resiliently attached to the frame 2. The levelling roll 6 carries projecting ski trail groove depressing rims 8. The drag has a plurality of successive blades 9, two of which carry obliquely upward and forward pointing snow collecting plates 10. The spring suspension of the trail planer has been arranged with telescopic springs 11 installed between the trail planer and the frame 2.

As the figures also reveal, the means has a design conducive to very light weight, and it is therefore easy to tow for instance with a snowmobile 1. Since the means has low height compared with the levelling roll running behind, the means can easily be transported in upside-down position, in which case only the levelling roll will contact the ground. In places with little snow, the trail planer 4 is adjusted to such height that it will not unnecessarily remove snow.

It is obvious to a person skilled in the art that various embodiments of the invention may vary within the scope of the claims following below.

I claim:

1. A ski trail making apparatus comprising a frame, adapted for attachment e.g. behind a snowmobile, a drag for levelling out old ski trails and tracks, linkage arms pivotally attached to the frame for suspending the drag therefrom, said drag being adjustable in the vertical direction and free to rise upwardly if an obstacle is encountered, a trail planer having trail making blades located side-by-side on said frame disposed behind said drag, means for resiliently mounting said trail planer on said frame, and a cylindrical levelling roll having projecting trail groove depressor rims thereon disposed behind said trail planer for supporting said apparatus.

2. Ski trail making apparatus according to claim 1, wherein the drag has a plurality of successive blades, at least one of which carries a snow collecting plate pointing obliquely upward and forward.

3. Ski trail making apparatus according to claim 1, wherein the suspension of the trail planer has been arranged with telescopic springs installed between the trail planer and the frame.

* * * * *